US005454494A

United States Patent [19]

Lechelle

[11] Patent Number: 5,454,494

[45] Date of Patent: Oct. 3, 1995

[54] ASSEMBLY FOR DISPENSING PRODUCT OF PASTY FLUID CONSISTENCY WITHOUT AIR UPTAKE, INCLUDING A DEFORMABLE MEMBRANE

[75] Inventor: Bernard Lechelle, Asnieres, France

[73] Assignee: L'Oreal, Paris, France

[21] Appl. No.: 280,119

[22] Filed: Jul. 25, 1994

[30] Foreign Application Priority Data

Jul. 30, 1993 [FR] France ..... 93 09411

[51] Int. Cl.[6] ..... B65D 25/40

[52] U.S. Cl. ..... 222/494

[58] Field of Search ..... 222/92, 107, 494, 222/213, 495, 496

[56] References Cited

U.S. PATENT DOCUMENTS

| | | | |
|---|---|---|---|
| 3,206,079 | 9/1965 | Mancusi, Jr. | 222/494 |
| 4,785,978 | 11/1988 | Kano et al. | 222/494 |
| 5,213,235 | 5/1993 | Miranda | 222/498 |
| 5,226,568 | 7/1993 | Newton et al. | 222/494 |

FOREIGN PATENT DOCUMENTS

| | | | |
|---|---|---|---|
| 253495 | 1/1988 | European Pat. Off. | 222/494 |
| 0496704 | 7/1992 | European Pat. Off. . | |
| 829056 | 6/1938 | France . | |
| 885095 | 9/1943 | France . | |
| 1327396 | 4/1963 | France . | |
| 1535749 | 8/1968 | France . | |
| 2032744 | 11/1970 | France . | |
| 9168 | 1/1989 | Japan | 222/494 |

*Primary Examiner*—Andres Kashnikow
*Assistant Examiner*—Philippe Derakshani
*Attorney, Agent, or Firm*—Young & Thompson

[57] ABSTRACT

Assembly for dispensing product of pasty fluid consistency, which includes a container (2) made of flexible material containing the product and a dispensing head which includes a dome (3) and is equipped with at least one dispensing orifice (4) capable of being closed by a movable stud (7) carried by an elastically deformable membrane (6), the container (2) and the dome (3) constituting a single piece obtained by moulding, a rigid insert (5) being put into position at the base of the dome (3) and delimiting a space (25) between the insert and the dome (3), the insert (5) including channels (23), which brings the space (25) into communication with the container (2), and carrying, opposite the orifice (4), the deformable membrane (6), the insert (5) consisting of a disc (14) through which are provided the channels (23) and of a support element (15) carrying the membrane (6), solidly attached to the disc (14), and arranged in the central region of the disc (14) which includes a circular plate (16), the central region of which is solid and which is moulded as a single piece with an annular element (17) which forms, together with the plate (16), a cylindrical blind housing (14a) inside which the support element (15) is fixed, the annular element (17) carrying, at its upper part, a flange (19) coming to bear against a step (3*a*) provided inside the dome (3) at the junction between the skirt (11) and the cupola (13).

10 Claims, 2 Drawing Sheets

ASSEMBLY FOR DISPENSING PRODUCT OF PASTY FLUID CONSISTENCY WITHOUT AIR UPTAKE, INCLUDING A DEFORMABLE MEMBRANE

The present invention relates to an assembly for dispensing product of pasty fluid consistency, including a container and a dispensing head equipped with a dispensing orifice capable of being opened or closed off by a stud translationally operated by a deformable membrane. This assembly can be used, especially, for the dispensing of cosmetic products, for example sun cream.

In the present description and in the claims, by "fluid product" is meant any product in the form of a liquid, cream or paste capable of flowing.

An assembly is known, from FR-A-829,056, which includes a container made of flexible material containing the fluid product to be dispensed and a dispensing head which includes a dome and is equipped with at least one dispensing orifice capable of being closed by a movable stud carried by an elastically deformable membrane, the orifice being closed off by the stud in the absence of any overpressure on the said membrane on the side where the said stud is located and being freed when an overpressure is applied to the said membrane on the side where the said stud is located, the-container and the dome constituting a single piece obtained by moulding, a rigid insert being put into position at the base of the dome and delimiting a space between the insert and the dome, the said insert including at least one channel, which brings the said space into communication with the container, and carrying, opposite the orifice, the deformable membrane, the latter imparting to the stud a bearing force against the edges of the opening, the said bearing force and the area of contact between the stud and the edges of the opening being, in the closure position, sufficient for the said closure to prevent any air uptake after dispensing, the insert consisting of a disc through which is (are) provided the channel (channels) and of a support element which carries the membrane and is solidly attached to the said disc, the support element being arranged in the central region of the disc.

Such an assembly makes it possible to ensure dispensing without air uptake by employing the opening and closing of a dispensing orifice by means of a stud operated by a deformable membrane. In the absence of air uptake, it is known that flexible containers gradually collapse with dispensing, thereby making it possible for the user to identify the state of filling of the container even if the wall is completely opaque. In addition, the absence of air uptake prevents deterioration, by oxidation, of the product in the course of dispensing and also prevents contamination of the product as regards bacteria, which would result in a possible reduction in the use of preservatives.

However, such a known assembly requires, in order to function correctly, a precise positioning of the stud with respect to the orifice; unfortunately, nothing is provided in the assembly according to FR-A-829,056 to facilitate this positioning, and the object of the present invention is to alleviate this drawback.

The present invention therefore relates to an assembly for dispensing product of pasty fluid consistency, which includes a container made of flexible material containing the fluid product to be dispensed and a dispensing head which includes a dome equipped with at least one dispensing orifice capable of being closed by a movable stud carried by an elastically deformable membrane, the orifice being closed off by the stud in the absence of any overpressure on the said membrane on the side where the said stud is located and being freed when an overpressure is applied to the said membrane on the side where the said stud is located, the container and the dome constituting a single piece obtained by moulding, a rigid insert being put into position at the base of the dome and delimiting a space between the insert and the dome, the said insert including at least one channel, which brings the said space into communication with the container, and carrying, opposite the orifice, the deformable membrane, the latter imparting to the stud a bearing force against the edges of the opening, the said bearing force and the area of contact between the stud and the edges of the opening being, in the closure position, sufficient for the said closure to prevent any air uptake after dispensing, the insert consisting of a disc through which is (are) provided the channel (channels) and of a support element which carries the membrane and is solidly attached to the said disc, the support element being arranged in the central region of the disc, characterized in that the disc includes, in its part facing the tube, a circular plate, the central region of which is solid and which is moulded as a single piece with an annular element which forms, together with the plate, a cylindrical blind housing inside which the support element is fixed, the annular element carrying, at its upper part, a flange coming to bear against a step provided inside the dome at the junction between the skirt and the cupola.

Thus, by virtue of this arrangement, the insert is put into position accurately by virtue of the step, and thus the stud is positioned accurately relative to the orifice.

The container is preferably constituted by a tube, the cylindrical skirt, of circular or oval cross-section, of which is moulded as one piece with the dome and which tube is closed by a linear weld in its region opposite the dome.

Advantageously, the support element comprises a cylindrical skirt which fits into the blind housing with a slight interference, and a base constituting the membrane. This arrangement makes it possible to limit the dead volume inside the dome.

The support element is preferably surrounded by a plurality of channels organized in a ring around it. The insert preferably consists of two separate pieces joined together: according to one particular embodiment, the disc includes, in its central region, a blind housing inside which the support element is fixed, the latter including a cylindrical region engaged in the said housing and a base constituting the membrane. This embodiment in two pieces makes it possible to obtain an assembly of greater rigidity and to limit the problems of sealing between the insert and the wall of the dome when the wall of the dome deforms; in fact, in order to mould the support element carrying the elastic membrane, a plastic may be used which is more flexible than that for moulding the disc in which the channel (channels) is (are) provided.

The stud and the edges of the orifice preferably have complementary shapes such that the area of contact between the end of the stud and the edge of the opening is large. The dispensing orifice advantageously includes a frustoconical bearing surface, the stud being shaped at its free end with a frustoconical bearing surface substantially of the same vertex angle.

The assembly advantageously includes a cap capable of covering the dome; the cap is fixed by fitting, clipping or screwing to the base of the dome. The cap preferably includes, on the inside, a nipple arranged in line with the dispensing orifice when the cap is fixed to the dome; according to a preferred embodiment, the dispensing orifice is terminated, towards the outside of the dome, by a frustoconical bearing surface, and the nipple is shaped at its free end with a frustoconical bearing surface of substantially the same vertex angle; the two frustoconical bearing surfaces of the dispensing orifice are preferably separated from each other by a cylindrical region. The cap thus makes it possible to prevent any accidental dispensing of the product during storage and during various handling operations, should a pressure be exerted on the container.

The various elements of the assembly may be moulded by using the same thermoplastic: in this case, polyethylene is more particularly used, this having the advantage of being recyclable; nevertheless, polyethylenes of different elasticities may be chosen; for example, a more rigid polyethylene may be used for the disc of the insert than for the support element. Nevertheless, it is preferable that the container/dome assembly be moulded from a different thermoplastic, especially a heat-sealable multilayer material, this type of material having the advantage of exhibiting greater air impermeability.

The assembly according to the invention is simple to manufacture. The various pieces are moulded separately: the piece formed by the wall of the non-closed container and the dome, the two pieces forming the insert, and, possibly, the cap. The two pieces forming the insert are joined together and then the insert is pushed into the container until it is in place at the base of the dome. Next, the product to be dispensed is introduced via the open end of the container and the open end of the latter is closed, especially by heat-sealing. In the case where the container is a tube, a linear weld, substantially perpendicular to the axis of the tube, is preferably effected. In order to finish, the cap is possibly arranged on the dome.

The assembly according to the invention functions in the following way: during use, the user removes the cap in order to expose the orifice provided on the dome; next, he compresses the side walls of the flexible container using his fingers. Under the pressure produced, the product contained in the container passes via the channels provided in the insert and penetrates into the space lying between the insert and the dome. The pressure exerted on the product by the user's fingers deforms the elastic membrane carrying the stud; this stud, which initially closed the dispensing orifice, moves translationally and frees the dispensing orifice; the product then emerges via the dispensing orifice and may be applied. Simultaneously, the container, which is flexible, collapses. When the user ceases pressing on the container, the pressure exerted by the product on the membrane ceases and the membrane comes back, by elasticity, into its first position, the stud closing the dispensing orifice once again.

Since the membrane very rapidly resumes its first position and the stud interacts in a sealed manner with the edge of the orifice, there is no air uptake; consequently, deterioration, by air oxidation, of the product to be dispensed and contamination of it by microorganisms in the air are prevented; the use of preservatives in the product to be dispensed may therefore be reduced. Additionally, the tube, after dispensing, remains in its partially collapsed state: the user may thus easily determine the quantity of product remaining in the tube, even if the latter is opaque.

Moreover, it should be noted that the space lying between the inserted piece and the dome may be proportionally very small compared to the volume of the container; the inside volume of the channels is also very small compared to the volume of the container; under these conditions, the dead volume is small, the quantity of non-expellable product which it contains is small and the recovered quantity of the product to be dispensed is therefore high.

In order to make the subject of the invention more understandable, an embodiment thereof will be described hereinbelow, by way of purely illustrative and non-limiting example, the embodiment being depicted in the appended drawing.

Figure 1:
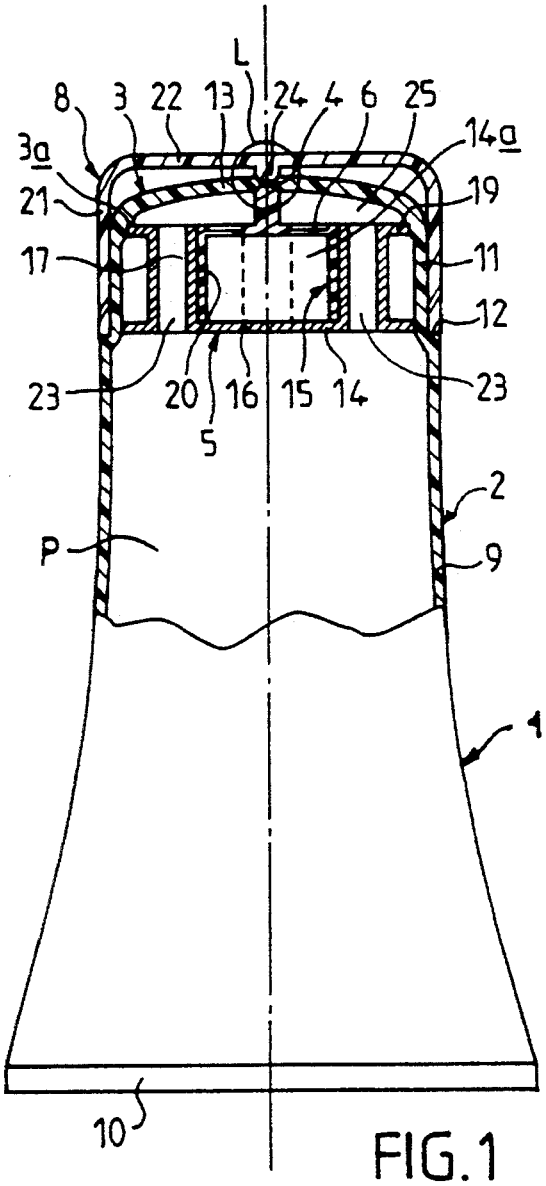
FIG. 1 is a partial sectional elevation view of an assembly according to the invention, including its cap, with sectional cut-away.
Figure 2:
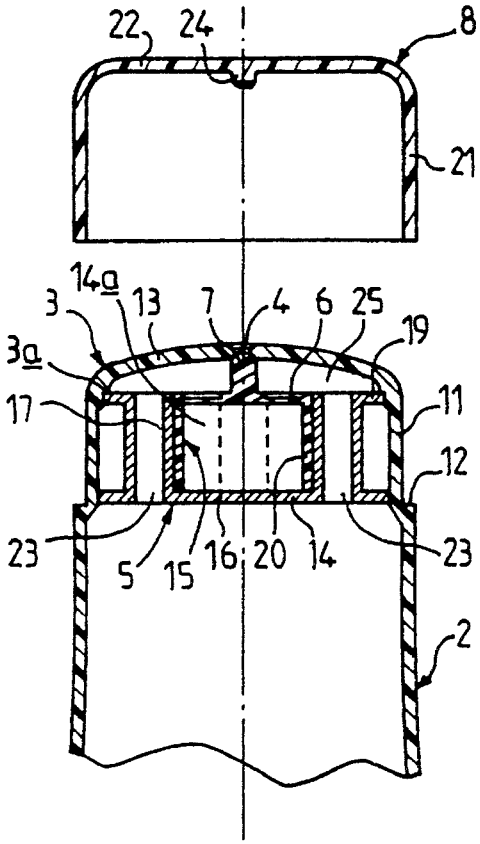
FIG. 2 is an axial sectional partial view of the dispensing assembly of FIG. 1 before dispensing, the cap being removed from the dome.
Figure 3:
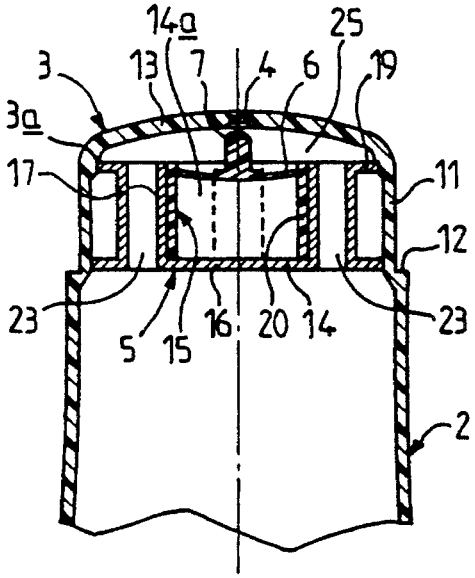
FIG. 3 is an axial sectional partial view of the dispensing assembly of FIG. 1 during dispensing, the cap being removed.
Figure 4:
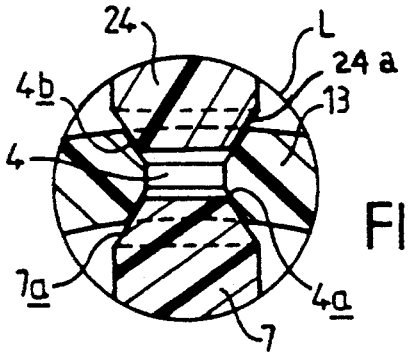
FIG. 4 depicts, on a large scale, the region L of FIG. 1.
Figure 5:
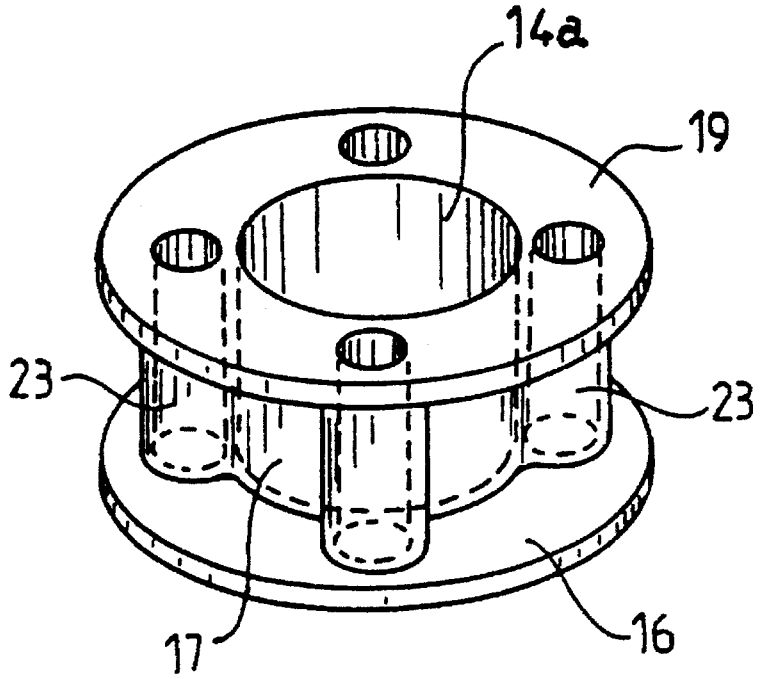
FIG. 5 depicts, in perspective, the disc of the insert.
Figure 6:
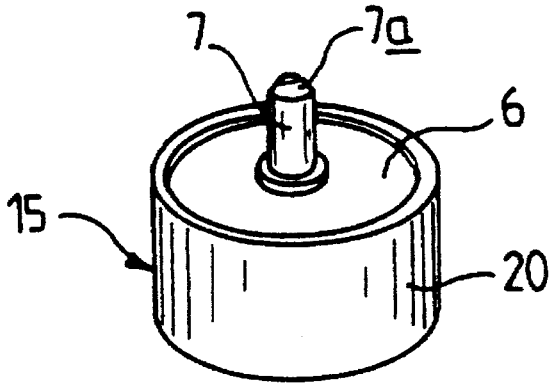
FIG. 6 depicts, in perspective, the support element of the insert.

The dispensing assembly 1 depicted in FIGS. 1 to 4 consists of a container formed by a tube 2 containing the product to be dispensed and of a dispensing head constituted by a dome 3 made as one moulding with the tube 2, and by an insert 5 in which channels 23 are provided, the said insert carrying an elastic membrane 6 equipped with a stud 7. The insert 5 is arranged at the base of the dome 3. An orifice 4 is provided in the dome 3. The dome 3 is covered by a cap 8.

The tube 2 is formed by a cylindrical skirt 9 pinched together at its end opposite the dome 3 by a linear weld 10. The dome 3 is coaxial with the tube 2; it consists, on the one hand, of a cylindrical skirt 11 of smaller diameter than the cylindrical skirt 9 of the tube 2, the skirt 11 being connected to the skirt 9 by a circular shoulder 12 and, on the other hand, of a cupola 13, the convexity of which faces outwards. A step **3*a* is provided on the inside of the dome 3 at the junction between the skirt 11 and the cupola 13. An orifice 4 is provided at the centre of the cupola 13; the side walls of the said orifice 4 (see FIG. 4) have the shape of two frustoconical bearing surfaces 4*a*, 4*b*** separated from each other by a cylindrical region.

The insert 5 consists of two pieces joined together by fitting: a disc 14, in which four channels 23 are provided, and a support element 15 carrying the membrane 6 equipped with the stud 7. The disc 14 includes, in its part facing the tube 2, a circular plate 16 which is equipped with four openings forming the entrance of the channels 23 and the central region of which is solid. This circular plate has a diameter equal, within the necessary clearance, to the internal diameter of the cylindrical skirt 11 of the dome 3. The circular plate 16 is moulded as one piece with an annular element 17 which forms, together with the plate 16, a cylindrical blind housing **14*a*. The annular element 17 carries, at its upper part, a flange 19 of external diameter equal, within the necessary clearance, to the diameter of the dome 3 beneath the step 3*a*, the flange 19 coming to bear against the step 3*a*. The channels 23 are uniformly arranged at the periphery of the annular element 17 and run out on one side in the plate 16 and on the other side in the flange 19**.

The support element 15 is constituted by the membrane 6 carrying at its centre the stud 7, which constitutes a circular transverse base, and by a cylindrical skirt 20, which has an external diameter equal to the internal diameter of the annular element 17 and which has the same height, so as to be able to fit, with a slight interference, into the blind housing **14*a* limited by the annular element 17 and the plate 16. The stud 7 is arranged in line with the orifice 4 provided in the axis of the dome 3 and the accuracy with which the insert 5 is put into position in the dome 3, by virtue of the step 3***a*, makes it possible to define the force by which the stud 7 bears against the edges of the orifice 4. The stud 7 is circular and its end has a frustoconical bearing surface 7*a* complementary to the frustoconical bearing surface 4*a* of the orifice 4 so as to obtain an area of contact between the stud 7 and the orifice 4 sufficient for the closure to be able to be airtight.

The cap 8 consists of a lateral skirt 21, the free edge of which comes to bear on the shoulder 12, by fitting, with a slight interference, onto the base of the dome 3 where the insert 5 is located. The skirt 21 is connected to a transverse circular base 22 carrying at its centre, on its internal face, a nipple 24 arranged in line with the orifice 4 when the cap is fitted onto the base of the dome 3; the nipple 24 is shaped at its free end with a frustoconical bearing surface 24*a* of substantially the same vertex angle as the frustoconical bearing surface 4*b* of the orifice 4.

The assembly according to the invention is manufactured in the manner described hereinbelow: four pieces are made up separately by moulding: the assembly formed by the cylindrical skirt 9 of the tube 2 and the dome 3, the two elements of the insert 5 (the disc 14 and the support element 15), and the cap 8. The tube 2 and the dome 3 are made of a heat-sealable multilayer plastic, and the other pieces are made of polyethylene. The disc 14 and the support element 15 are joined to each other by inserting the skirt 20 into the blind housing 14*a*, which is thus closed by the elastic membrane 6. The insert 5 thus assembled is introduced via the open end of the tube 2 and it is pushed right in until the flange 19 comes into abutment against the step 3*a* provided in the internal wall of the dome 3; the step 3*a* makes it possible to put the insert into position precisely and, consequently, to position the stud 7 with respect to the orifice 4 precisely. In addition, the insert 5 stiffens the cylindrical skirt 11 of the dome and, consequently, the convex cupola 13; in this way, the dispensing head is substantially rigid. Next, the tube 2 is filled using the product P which is, for example, a sun cream, and the linear weld 10 is effected by heat-sealing after pinching together the walls of the skirt 9. The filling of the tube 2 is performed under vacuum so as to prevent any contamination through the air during filling.

When it is desired to use the product P, the user removes the cap 8. Next, he presses on the tube 2 with his fingers. The product P contained in the tube 2 then passes via the channels 23 into the space 25 lying between the insert 5 and the dome 3. The pressure exerted by the product deforms the elastic membrane 6 which, initially planar (see FIG. 1), becomes concave (see FIG. 3). The stud 7 fixed to the elastic membrane 6, which closed the orifice 4 (see FIG. 1) then moves translationally and frees the orifice 4 in the dome 3 (see FIG. 3): the product P is dispensed via the orifice 4. When the user ceases to exert a pressure on the tube 2, the elastic membrane 6 resumes, by elasticity, its planar shape and the stud 7 comes back to close the orifice 4: dispensing of the product ceases. The elastic membrane 6 rapidly resumes its shape and there is no air uptake: in addition, the valve constituted by the stud 7 and the orifice 4 is perfectly airtight. Under these conditions, the tube 2 cannot elastically resume its initial volume and it remains collapsed: it is, consequently, easy for the user to determine the quantity of product P remaining in the tube 2. In addition, since there is no air uptake, there is no risk of contamination of the product through the air.

I claim:

1. In an assembly for dispensing product of pasty fluid consistency, which includes a container (2) made of flexible material containing the fluid product to be dispensed and a dispensing head which includes a dome (3) and is equipped with at least one dispensing orifice (4) capable of being closed by a movable stud (7) carried by an elastically deformable membrane (6), the orifice (4) being closed off by the stud (7) in the absence of any overpressure on the said membrane on the side where the said stud is located and being freed when an over-pressure is applied to the said membrane on the side where the said stud is located, the container (2) and the dome (3) constituting a single piece obtained by moulding, a rigid insert (5) being put into position at the base of the dome (3) and delimiting a space (25) between the insert and the dome (3), the said insert (5) including at least one channel (23), which brings the said space (25) into communication with the container (2), and carrying, opposite the orifice (4), the deformable membrane (6), the latter imparting to the stud (7) a bearing force against the edges of the opening (4), the said bearing force and the area of contact between the stud (7) and the edges of the opening (4) being, in the closed position, sufficient for the said closure to prevent any air uptake after dispensing, the insert (5) consisting of a disc (14) through which is provided the at least one channel (23) and of a support element (15) which carries the membrane (6) and is solidly attached to the said disc (14), the support element (15) being arranged in the central region of the disc (14); the improvement wherein the disc (14) includes, in its part facing the tube (2), a circular plate (16), the central region of which is solid and which is moulded as a single piece with an annular element (17) which forms, together with the plate (16), a cylindrical blind housing (14*a*) inside which the support element (15) is fixed, the annular element (17) carrying, at its upper part, a flange (19) that bears against a step (3a) provided insides the dome (3).

2. Assembly according to claim 1, wherein that the support element (15) comprises a cylindrical skirt (20) which fits into the blind housing (14*a*) with a slight interference, and a base constituting the elastic membrane (6).

3. Assembly according to claim 1, wherein that the support element (15) is surrounded by a plurality of channels (23) organized in a ring around it.

4. Assembly according to claim 3, wherein the circular plate (16) is equipped with four openings forming the entrance of the channels (23) which are uniformly arranged at the periphery of the annular element (17) and which run out in the flange (19).

5. Assembly according to claim 1, wherein the dispensing orifice (4) includes, opposite the elastic membrane (6), a frustoconical bearing surface (4*a*), the stud (7) being shaped at its free end with a frustoconical bearing surface (7*a*) substantially of the same vertex angle as said frustoconical bearing surface (4*a*) of said dispensing orifice (4).

6. Assembly according to claim 1, which further includes a cap (8) capable of covering the dome (3), said cap being fixed to the base of the dome.

7. Assembly according to claim 6, wherein the cap (8) includes, on the inside, a nipple (24) arranged in line with the dispensing orifice (4) when the cap is fixed to the dome (3).

8. Assembly according to claim 7, wherein the dispensing orifice (4) is terminated, towards the outside of the dome (3), by a frustoconical bearing surface (4*b*), and in that the nipple (24) is shaped at its free end with a frustoconical bearing surface (24*a*) of substantially the same vertex angle as said frustoconical bearing surface (4*b*) of said dispensing orifice (4).

9. Assembly according to claims 5 wherein the two frustoconical bearing surfaces (4*a*, 4*b*) of the dispensing orifice (4) are separated from each other by a cylindrical region.

10. Assembly according to one of claim 1, wherein the container (2) and the dome (3) are produced from a heat-sealable multilayer plastic whereas the disc (14) and the support element (15) are produced from a moulded thermoplastic.

* * * * *